US009918597B2

(12) United States Patent
Rubenson et al.

(10) Patent No.: US 9,918,597 B2
(45) Date of Patent: Mar. 20, 2018

(54) HYGIENIC SHEET MATERIAL DISPENSER

(71) Applicant: SCA Hygiene Products AB, Göteborg (SE)

(72) Inventors: Johan Rubenson, Göteborg (SE); Daniele Salvatore Tedesco, Philadelphia, PA (US)

(73) Assignee: SCA HYGIENE PRODUCTS AB, Göteberg (SE)

( * ) Notice: Subject to any disclaimer, the term of this patent is extended or adjusted under 35 U.S.C. 154(b) by 0 days.

(21) Appl. No.: 15/112,711

(22) PCT Filed: Jan. 22, 2014

(86) PCT No.: PCT/SE2014/050076

§ 371 (c)(1),
(2) Date: Jul. 20, 2016

(87) PCT Pub. No.: WO2015/112061

PCT Pub. Date: Jul. 30, 2015

(65) Prior Publication Data

US 2016/0331192 A1 Nov. 17, 2016

(51) Int. Cl.
*A47K 10/36* (2006.01)
*A47K 10/38* (2006.01)

(52) U.S. Cl.
CPC ..... *A47K 10/36* (2013.01); *A47K 2010/3668* (2013.01); *A47K 2010/3881* (2013.01)

(58) Field of Classification Search
CPC ..... A47K 10/36; A47K 2010/3881; A47K 2010/3668
See application file for complete search history.

(56) References Cited

U.S. PATENT DOCUMENTS 4,960,248 A * 10/1990 Bauer ..... A47K 10/36 242/564.4
6,695,246 B1 * 2/2004 Elliott ..... A47K 10/36 242/563

(Continued)

FOREIGN PATENT DOCUMENTS

WO WO-2007/068269 A1 6/2007
WO WO-2014/001944 A1 1/2014

OTHER PUBLICATIONS

Extended European search report dated May 10, 2017 issued in corresponding European patent application No. 14880073.3 (7 pages).

*Primary Examiner* — William A. Rivera
(74) *Attorney, Agent, or Firm* — Drinker Biddle & Reath LLP

(57) ABSTRACT

A hygienic sheet material dispenser includes a housing with a dispensing opening, a compartment for a sheet material product, a first sensor arranged to assume an active mode in which it scans for the presence of a user, a dispensing motor arranged to drive a driving mechanism, a second sensor for sensing when a piece of said product has been removed, and a microcontroller connected to the first sensor, the second sensor and the dispensing motor, said dispenser also being configured to be switched to a passive mode. The dispenser is arranged to switch to the passive mode after a first predetermined period of time has elapsed in the active mode without detection of a user; wherein, upon entering the passive mode, a length of said product is fed from the dispenser out of the dispensing opening and the first sensor and the microcontroller are substantially deactivated; and wherein the dispenser is arranged to switch back to the active mode when the second sensor senses that said product has been removed.

15 Claims, 3 Drawing Sheets

(56) References Cited

U.S. PATENT DOCUMENTS

| | | | | |
|---|---|---|---|---|
| 6,820,785 | B2 * | 11/2004 | Kapiloff | A47K 10/36 225/10 |
| 7,370,824 | B1 | 5/2008 | Osborne | |
| 7,523,885 | B2 * | 4/2009 | Lewis | A47K 10/36 242/563 |
| 2003/0167893 | A1 | 9/2003 | Morris et al. | |
| 2005/0145745 | A1 * | 7/2005 | Lewis | A47K 5/06 242/563 |
| 2008/0100185 | A1 * | 5/2008 | Lewis | A47K 10/36 312/34.22 |
| 2010/0089939 | A1 | 4/2010 | Morris et al. | |
| 2012/0312853 | A1 * | 12/2012 | Osborne | A47K 10/36 225/10 |
| 2013/0248644 | A1 * | 9/2013 | Goeking | A47K 10/26 242/564.1 |
| 2016/0325957 | A1 * | 11/2016 | Borke | G05B 15/02 |

* cited by examiner

HYGIENIC SHEET MATERIAL DISPENSER

CROSS-REFERENCE TO PRIOR APPLICATION

This application is a § 371 National Stage Application of PCT International Application No. PCT/SE2014/050076 filed Jan. 22, 2014, which is incorporated herein in its entirety.

TECHNICAL FIELD

The disclosure relates to a hygienic sheet material dispenser including a housing with a dispensing opening, a compartment for a sheet material product, a first sensor arranged to assume an active mode in which it scans for the presence of a user, a dispensing motor arranged to drive a driving mechanism, a second sensor for sensing when a piece of said product has been removed, and a microcontroller connected to the first sensor, the second sensor and the dispensing motor, said dispenser also being configured to be switched to a passive mode.

The disclosure also relates to a method for operating a dispensing unit.

BACKGROUND

Automatic paper dispensers are known in the art. They are usually placed in public restrooms at various locations. They have a variety of functions which all require electric power in order to work, for example a sensor for sensing a user in the vicinity of the dispenser, a microcontroller and a drive motor to dispense paper out of the dispenser. Upon sensing a user being in the vicinity of the dispenser, said electric motor may be operated so as to dispense paper for the user to tear from the dispenser.

A disadvantage with today's automatic paper dispensers is that they have a relatively high power consumption, for instance due to the fact that the dispenser may be actively searching for a user by means of a sensor during times when there are few or no users in the restroom. This limits the battery life time of the dispenser.

A number of solutions have previously been applied to reduce power consumption in dispensers. One example is where the dispenser reduces the scan rate of the sensor for sensing a user after a period of time during which no actuation of the dispenser has been initiated. However, dispensers today still draw unnecessary power during periods when there are few or no users in a restroom. There is thus a need for an improved automatic dispenser.

SUMMARY

It is desired to provide an improved hygienic sheet material dispenser where the previously mentioned problems are at least partly avoided. It is also desired to provide an improved method for controlling the operation of a hygienic sheet material dispenser.

An aspect relates to a hygienic sheet material dispenser including a housing with a dispensing opening, a compartment for a sheet material product, a first sensor arranged to assume an active mode in which it scans for the presence of a user, a dispensing motor arranged to drive a driving mechanism, a second sensor for sensing when a piece of said product has been removed, and a microcontroller connected to the first sensor, the second sensor and the dispensing motor, said dispenser also being configured to be switched to a passive mode. Furthermore, the dispenser is arranged to switch to the passive mode after a first predetermined period of time has elapsed in the active mode without detection of a user; wherein, upon entering the passive mode, a length of said product is fed from the dispenser out of the dispensing opening and the first sensor and the microcontroller are substantially deactivated; and wherein the dispenser is arranged to switch back to the active mode when the second sensor senses that said product has been removed.

A dispenser according to certain embodiments uses a first operating mode in the form of an "active mode", wherein the first sensor scans for the presence of a user, and a further operating mode in the form of a "passive mode". The passive mode corresponds to an energy saving mode of operation, wherein the electronics of the dispenser first dispenses a product out from the dispenser, then shuts down certain functions of the dispenser in order to obtain a very low consumption of electric current. This allows for a longer battery life for the dispenser. The dispenser then returns to the active mode when the piece of product previously dispensed is removed by a user.

According to a further aspect, a hygienic sheet material dispenser includes a housing with a dispensing opening, a compartment for a sheet material product, a first sensor arranged to assume an active mode in which it scans for the presence of a user with a first predetermined scan rate, a dispensing motor arranged to drive a driving mechanism, a second sensor for sensing when a piece of said product has been removed, and a microcontroller connected to the first sensor, the second sensor and the dispensing motor, said dispenser also being configured to be switched to a passive mode. According to this aspect, the dispenser is arranged to switch to a low scan mode after a second predetermined period of time has elapsed in the active mode without detection of a user; wherein, in the low scan mode, the first sensor is arranged to scan for the presence of a user at a second predetermined scan rate which is lower than said first scan rate; and wherein the dispenser is arranged to switch from the low scan mode to the passive mode after a third predetermined period of time has elapsed in the low scan mode without detection of a user; wherein, upon switching to the passive mode, said product is dispensed from the dispenser out from the dispensing opening and the first sensor and the microcontroller are substantially deactivated; and wherein the dispenser is arranged to switch back to the active mode upon the second sensor sensing that said product has been removed.

According to this latter aspect, the dispenser consequently uses a third operating mode in the form of a "low scan mode" in which the first sensor scans for the presence of a user at a lower scan rate than in the active mode. Furthermore, if a third predetermined period of time elapses in the low scan mode without any user being detected, the dispenser switches from the low scan mode to the passive mode. During the passive mode, a piece of product is dispensed out from the dispensing opening and the first sensor and the microcontroller are substantially deactivated. The dispenser then returns to the active mode when the piece of product previously dispensed is removed by a user of the dispenser.

According to an aspect, the driving mechanism includes a first roller and a second roller defining a nip between them for defining a path for the sheet material. One of the rollers is driven by the dispensing motor.

A dispenser according to certain embodiments functions in a manner involving sensor operation (for user detection) during periods with many users. However, and as mentioned above, during periods with few users the dispenser can enter a passive mode, i.e. in the form of an energy saving mode, wherein electronic devices such as the first sensor and the microcontroller are substantially deactivated. In this context, the term "substantially deactivated" is used to define a condition in which the microcontroller shuts down power to any active sensors, such as the first sensor, and to other power consuming functions, but may keep indicator lights turned on. In this manner, electric power consumption is reduced to a minimum.

The dispenser includes a second sensor for sensing when a piece of said product has been removed. According to an aspect, the second sensor is constituted by a mechanical switch which senses when a piece of the product in the dispenser is removed by a user. This can be detected when a user removes a piece of the product by tearing it from a roll or a similar supply of material. According to a further aspect, the second sensor is constituted by an optical sensor which is configured to detect—suitably through the use of a light emitting diode cooperating with a photo detector—when a piece of said product is removed. It should be noted that in the event that an optical sensor is used, it must be active during the above-mentioned passive mode for sensing any removal of said piece of product.

In particular embodiments, one function which is active allows all functions of the microcontroller to wake up upon the second sensor sensing that product is torn off or otherwise removed, i.e. any passive sensors are still able to transmit information to the microcontroller when the microcontroller is substantially deactivated. Upon waking up, the microcontroller reactivates the first sensor which again starts to scan for the presence of a user.

In particular embodiments, entering the passive mode, a piece of the product in question is dispensed out of the dispenser before the first sensor and microcontroller are substantially deactivated. This means that the product is always available and a user wanting to use the dispenser does not have to wait for the dispenser to be activated before being able to obtain said product.

The first sensor may be a capacitive proximity sensor. According to a further aspect, the first sensor may be an IR proximity sensor.

The second sensor may be a tear-bar switch, i.e. suitably a mechanical switch having no current consumption when not activated, and which is actuated by the paper pressing against the tear bar when product is torn off. According to a further aspect, the second sensor may be an optical sensor including a light emitting device which is associated with a photo detector. Light emitted from the light emitting device is guided across an expected path of the sheet material in the dispenser. When a piece of said sheet material is removed by a user, the light from the light emitting device will strike the photo detector, which then will emit a signal which corresponds to a condition wherein the piece of sheet material has been removed.

The first predetermined period of time may be between 3 minutes and 60 minutes, between 20 minutes and 40 minutes, or 30 minutes.

The second predetermined period of time may be between 0.5 minutes and 20 minutes, between 5 minutes and 10 minutes, or 7 minutes.

According to an aspect, the above-mentioned second period of time is shorter than the first period of time.

Furthermore, the third predetermined period of time may be between 3 minutes and 60 minutes, between 20 minutes and 40 minutes, or 30 minutes.

The dispenser may be powered by batteries and/or an electrical mains. The dispenser may be arranged to switch to the passive mode only if the dispenser is powered by batteries. If the dispenser is connected to an electric power mains, the dispenser will suitably only operate in the active mode and the low scan mode. This keeps the paper inside the dispenser until it is requested by a user. When the dispenser is powered by batteries, i.e. when there is a limited supply of power, the dispenser will in order to save power also use the passive mode.

The invention can be realised both as a complete dispenser with all necessary mechanics and electronics being built-in and as an insert including mechanics and electronics which can be removably mounted in an empty housing. This means that the invention may include a space for accommodating sheet material, a discharge opening for the sheet material, a fastening arrangement for fastening onto a wall and other necessary components. The dispenser may include a housing wherein the housing is a dispenser frame including a dispensing opening. An insert may be arranged to be inserted into the dispenser frame. The first sensor, the dispensing motor arranged to drive the driving mechanism, the second sensor and the microcontroller are in this configuration arranged in the insert.

The disclosure further relates to a method for controlling the operation of a hygienic sheet material dispenser. The dispenser includes a housing with a dispensing opening and a compartment for a sheet material product. The method includes: scanning for the presence of a user by means of a first sensor during an active mode; driving a driving mechanism by means of a dispensing motor upon detecting the presence of a user by the first sensor; sensing whether a piece of said sheet material product has been removed by means of a second sensor; controlling the operation of the dispenser by means of a microcontroller connected to the first sensor, the second sensor and the dispensing motor, and selectively switching said dispenser unit to a passive mode. Furthermore, the method includes: switching from the active mode to the passive mode after a first predetermined period of time has elapsed in the active mode without detection of a user; dispensing a piece of said product from the dispenser out from the dispensing opening upon switching to the passive mode and substantially deactivating the first sensor and the microcontroller; and switching back to said active mode when said second sensor senses that a piece of said product has been removed.

According to a further aspect, a method for controlling the operation of a hygienic sheet material dispenser, includes a housing with a dispensing opening and a compartment for a sheet material product. The method includes: scanning for the presence of a user by means of a first sensor during an active mode and with a first predetermined scan rate; driving a driving mechanism by means of a dispensing motor upon detecting the presence of a user by the first sensor; sensing whether a piece of said sheet material product has been removed by means of a second sensor; controlling the operation of the dispenser by means of a microcontroller connected to the first sensor, the second sensor and the dispensing motor, and selectively switching said dispenser to a passive mode. The method further includes: switching from the active mode to a low scan mode after a second predetermined period of time has elapsed in the active mode without detection of a user; scanning for the presence of a user, in said low scan mode, by means of said first sensor and with a second predetermined scan rate which is lower than said first scan rate; switching from said low scan mode to said passive mode after a third predetermined period of time has elapsed in the low scan mode without detection of a user; dispensing a piece of said product from the dispenser out from the dispensing opening upon switching to the passive mode and substantially deactivating the first sensor and the microcontroller; and switching from the passive mode and back to the active mode when the second sensor senses that said piece has been removed.

In summary, embodiments of the invention can be implemented in different ways, for example in accordance with a first aspect which uses an active mode and a passive mode; or in accordance with a further aspect which uses an active mode, a passive mode and a low scan mode.

When the dispenser is arranged to be powered by batteries or an electrical mains, said method may include a step of switching to the passive mode only if the dispenser is powered by batteries.

When the supply of said sheet material product is a continuous roll of paper or a stack of folded continuous paper; said method may include dispensing a predetermined length of paper upon activation of the first sensor or second sensor.

When said sheet material product is a roll of paper sheets or a stack of connected paper sheets; said method may include dispensing a sheet of paper upon activation of the first sensor or second sensor.

BRIEF DESCRIPTION OF DRAWINGS

Embodiments of the invention will be described below with reference to the appended drawings, in which.

DETAILED DESCRIPTION OF DRAWINGS

Figure 1:
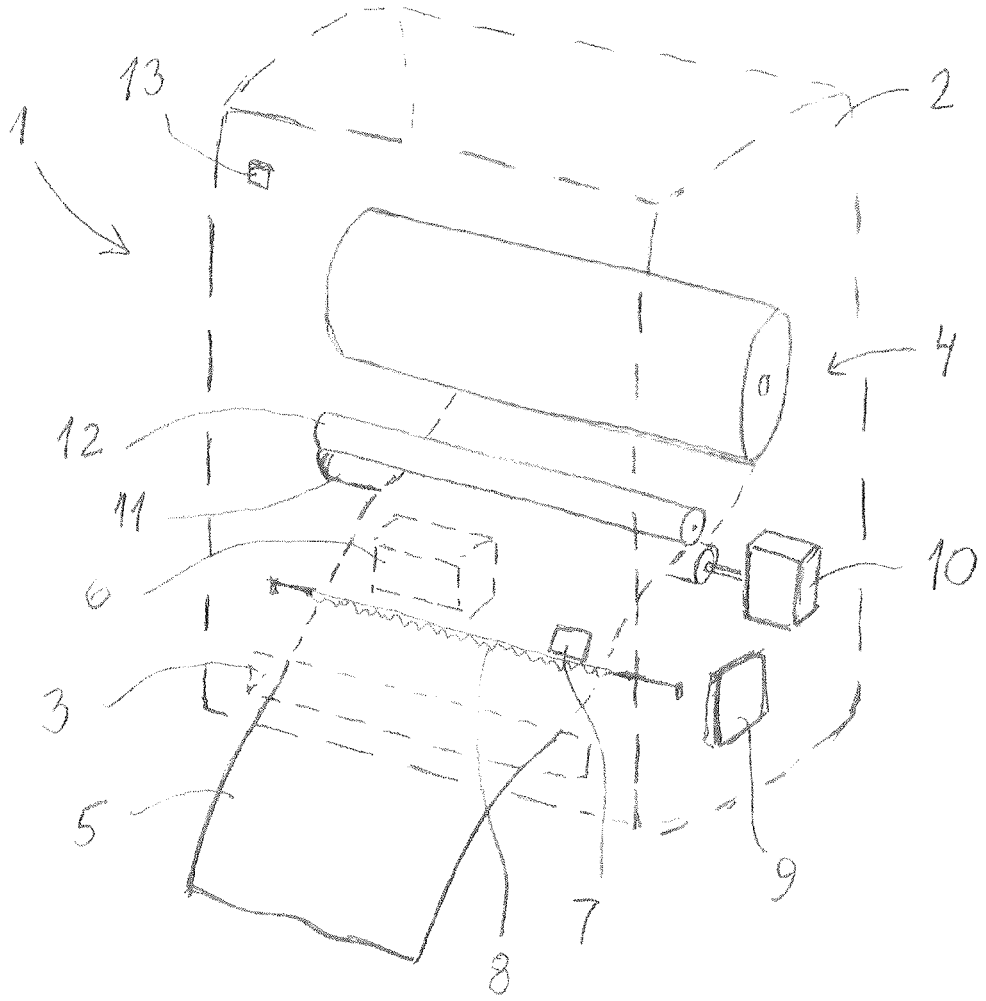
FIG. 1 schematically shows a dispenser according to an aspect of the invention, FIG. 2 schematically shows a flowchart for operation of a dispenser according to an aspect of the invention, and FIG. 3 schematically shows a flowchart for operation of a dispenser according to an aspect of the invention.

FIG. 1 schematically shows a dispenser 1 according to an aspect of the invention. In order to clearly explain the design and operation of the dispenser 1, the contour of the dispenser 1 is indicated with broken lines in FIG. 1.

The dispenser 1 includes a housing 2 with a dispensing opening 3. The dispenser 1 further includes a compartment 4 (not shown in detail) for a sheet material product 5. According to an embodiment, as indicated in FIG. 1, the sheet material product 5 is constituted by a continuous roll of wiping paper. According to an alternative embodiment, the sheet material product can be in the form of a stack of paper sheets, i.e. a folded but continuous web of paper forming said stack.

The dispenser 1 further includes a first sensor 6 arranged to scan for the presence of a user and a second sensor 7 located near the dispensing opening 3 for sensing that a piece of said product 5 has been torn off or otherwise removed. Suitably, the first sensor 6 is a capacitive sensor which is configured for sensing whether a user's hand or fingers are close to the first sensor 6.

Also, in order to simplify dispensing of the sheet material product 5, the dispenser 1 is suitably provided with a tear-bar arrangement 8 by means of which a piece of said product 5 can be torn off easily by a user. As indicated in FIG. 1, the second sensor 7 is suitably associated with the tear-bar arrangement 8 in a manner so that actuation of the tear-bar arrangement 8 mechanically influences the second sensor 7.

In this manner, a signal is generated in the second sensor 7 indicating that the tear-bar arrangement 8 has been actuated so that a piece of the sheet material product 5 has been removed by a user.

According to the aspect shown in FIG. 1, the second sensor 7 is a mechanical switch sensing when a piece of the sheet material in the dispenser 1 is removed. More precisely, when a user stretches and tears off a piece of the sheet material, this stretching will influence the tear-bar arrangement 8 so as to be slightly displaced. This movement can then be sensed by the second sensor 7.

According to another aspect, not shown in the drawings, the second sensor can be an optical sensor which is also configured so as to detect when a piece of the sheet material is removed. Suitably, this can be achieved through the use of a light emitting diode transmitting light through an expected path of the material in the dispenser 1. The light emitting diode cooperates with a photodetector. When a piece of sheet material is removed, the light from the light emitting diode will strike the photodetector which corresponds to a condition in which the piece of material has been removed.

The first sensor 6 and the second sensor 7 are connected to a microcontroller 9. The dispenser 1 also includes a dispensing motor which suitably is constituted by an electric motor 10, which is also connected to the microcontroller 9. As mentioned, the sheet material 5 may be provided in the form of a roll of paper, in which case the dispenser 1 also includes a driving mechanism which suitably comprises a first roller 11 and a second roller 12. The rollers 11, 12 define a nip between them through which the paper 5 is fed. Also, the first roller 11 is driven by the motor 10 so as to feed the paper 5 towards the dispensing opening 3.

According to an alternative aspect, the sheet material can be a stack of paper sheets, i.e. a folded web of paper forming said stack, in which case the driving mechanism is particularly configured for feeding a predetermined length of said web.

In a first operating mode, which is in this context is also referred to as an "active mode", the microcontroller 9 and the dispensing mechanism, i.e. the motor 10 and the driving mechanism 11, 12, cooperate with the sheet material product 5 in a manner so that a predetermined length of said product 5 or a sheet of product is fed out of the dispenser 1 when a user is sufficiently close to the first sensor 6 so that the first sensor 6 is activated. This normally corresponds to a situation when a user reaches out and holds a hand just in front of the dispenser 1 so that the first sensor 6 registers that the user is sufficiently close for feeding out said product 5.

The dispenser 1 may further include indicator lights 13 such as LEDs in order to show a status of the dispenser 1. The term "status" may refer to a condition such as for example a "low battery charging" condition, a "low level of paper" condition, or similar conditions. FIG. 1 schematically illustrates a piece of sheet product 5 after the product 5 has been dispensed out from of the dispensing opening 3.

As mentioned above, the dispensing unit 1 is configured for assuming an active mode wherein the first sensor 6 is used for triggering dispensing of a length of the sheet material product 5. In this active mode, no sheet material is hanging out of the dispensing unit 1 until a user approaches the first sensor 6 and the sheet material 5 is fed out of the dispensing opening 3. Furthermore, the dispensing unit 1 is also configured for assuming a second mode of operation, here referred to as a "passive mode". This latter mode will be assumed after a certain period of time has elapsed in the active mode without any user having been detected. This means that if the dispensing unit 1 has been idle for said period of time, the dispensing unit 1 will enter the passive mode in order to save energy. This is particularly relevant in cases where the dispensing unit 1 is operated entirely by means of battery power.

Upon entering the passive mode, a length of the sheet material product 5 is fed out of the dispensing opening 3 so that this piece of sheet material is ready to be removed from the roll of material. Also, the first sensor 6 and the microcontroller 9 are substantially deactivated, so that only a minimum of energy is consumed. When a user arrives to the dispensing unit 1 the next time, and grabs and tears off the piece of sheet material which is now visibly hanging out of the dispensing unit 1, the second sensor 7, which is associated with the tear-bar arrangement 8, is actuated. This causes the microcontroller 9 to switch the dispensing unit 1 from the passive mode and back to the active mode, wherein the first sensor 6 again is ready to be activated by the presence of a user.

As mentioned, the first sensor 6 is active to detect a user in the active mode. It should also be noted that when a piece of sheet material has been fed out of the dispensing opening 3 (in the active mode), the first sensor 6 is preferably deactivated. This means that, according to this aspect, there will be no scanning during this waiting condition in the active mode so as to detect a user when the sheet material is hanging out of the dispenser 1. Otherwise, additional pieces of the sheet material will be fed out if a user approaches the first sensor 6.

However, according to a further aspect, there may be an intention to allow feeding a longer piece of sheet material during the active mode and upon detection of the presence of a user. In such case, the first sensor 6 continues scanning in a normal active way until the first predetermined period of time has run out and low scan mode is reached.

In any case, scanning by means of the first sensor is resumed once the piece of sheet material has been removed by a user.

In summary, the dispenser 1 may consequently assume a waiting condition after a desired number of sheet material pieces have been fed out (as a result of the first sensor 6 having detected the presence of a user). No further scanning by means of the first sensor 6 is carried out until the piece of sheet material has been removed.

Furthermore, regarding the second sensor 7, it should be noted that if the second sensor 7 is a mechanical switch, it can be completely deactivated during the passive mode. However, if the second sensor is an optical sensor, it will have to be active to a certain extent also during the passive mode, i.e. to be able to detect whether a piece of sheet material hanging out is removed from the supply of sheet material. From an energy consumption point of view, it is therefore most suitable to use a mechanical switch as the second sensor 7.

Figure 2:
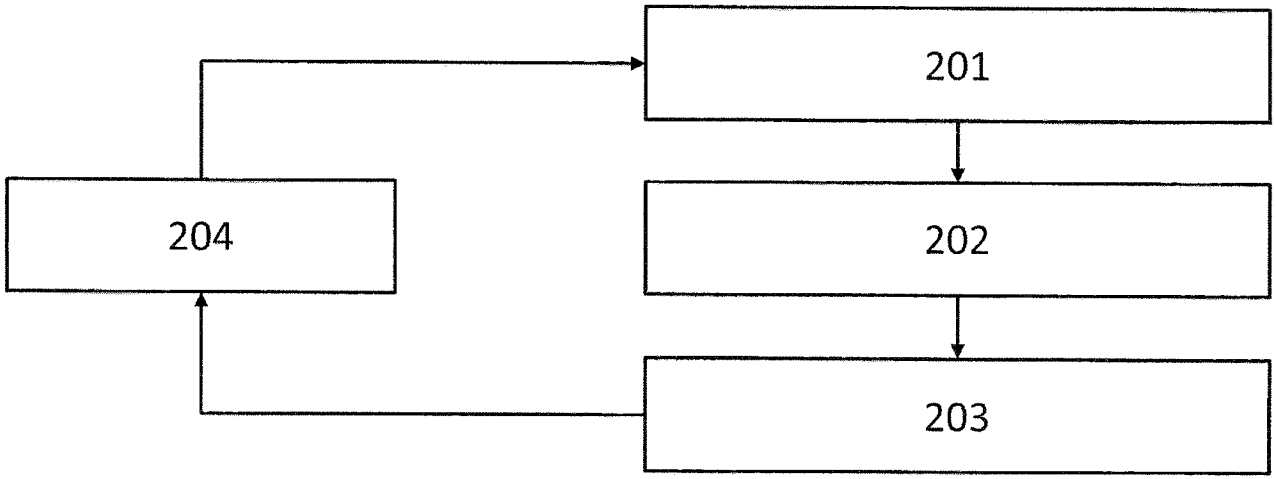

FIG. 2 schematically shows a flowchart for operation of a dispenser 1. In box 201 the dispenser 1 is in the first, active, operating mode in which the first sensor 6 scans at a first scan rate. Box 202 illustrates a situation in which it has been determined that no user has been detected in the active mode during a first predetermined period of time. This means that the microcontroller 9 switches the dispensing unit 1 to the second mode, also referred to as the passive mode. Box 203 corresponds to this passive mode and consequently illustrates that the dispensing motor 10 is actuated so as to dispense a piece of sheet material product 5 out from the dispensing opening 3. Also, at this stage the microcontroller 9 shuts down as many energy-consuming functions of the dispensing unit 1 as possible, i.e. substantially deactivating at least the first sensor 6 and the microcontroller 9.

Furthermore, in box 203 the second sensor 7 is passively waiting to be activated by tearing of sheet supply product and a wake-up function in the microcontroller 9 is active. Indicator lights 13 (cf FIG. 1) in the dispenser may or may not be active depending on which set up is chosen. Box 204 illustrates switching from the passive mode to the active mode upon the second sensor 7 sensing that said piece of product 5 has been torn off or otherwise removed.

Figure 3:
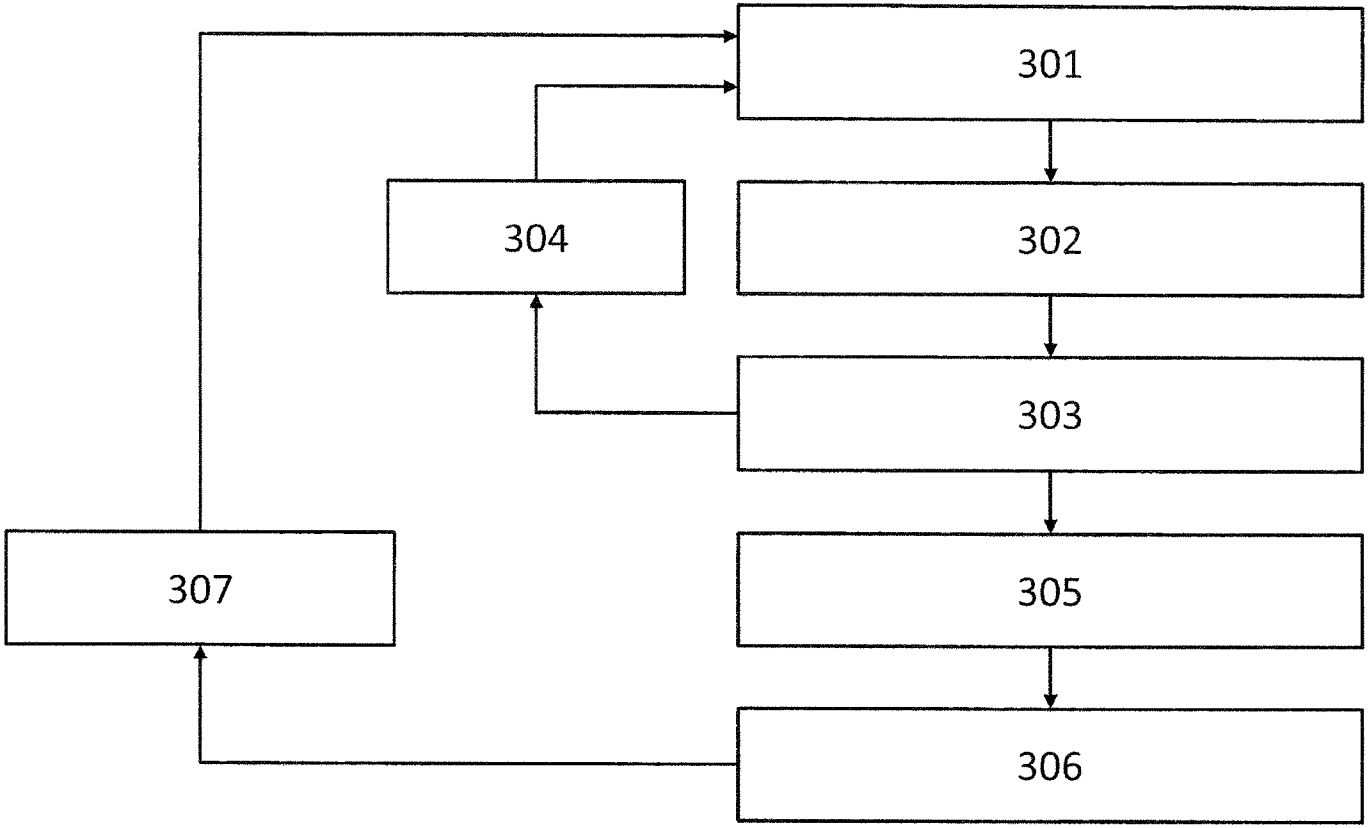

FIG. 3 schematically shows a flowchart for operation of a dispenser 1 according to an example of the invention. In box 301 the dispenser 1 is in the active mode wherein the first sensor 6 scans at a first scan rate. Box 302 illustrates that no user has been detected in the active mode during a second predetermined period of time. Box 303 illustrates switching from the active mode to a low scan mode after the second predetermined period of time. The low scan mode corresponds to a mode in which the first sensor 6 scans for the presence of a user at a second scan rate which can be lower than the first scan rate. This means that the first sensor 6 draws less current during the low scan mode than during the active mode.

As mentioned above, the first sensor 6 is active in the active mode but not when a piece of sheet material has just been fed out of the dispenser 1 during the active mode. A similar mode of operation applies also during the low scan mode, i.e. if the presence of a user is detected by the first sensor 6 during the low scan mode, the dispenser 1 feeds a piece of sheet material and returns to the active mode.

Box 304 illustrates switching to the active mode after a user has been detected in the low scan mode. Box 305 illustrates that no user has been detected in the low scan mode during a third predetermined period of time. Box 306 illustrates that the driving mechanism operated by means of the dispensing motor 10 dispenses a piece of product 5 out from the dispensing opening 3 upon switching to the passive mode and substantially deactivating the first sensor 6 and the microcontroller 9. In box 306 the second sensor 7 is passively waiting to be activated by tearing of sheet supply product and a wake-up function in the microcontroller 9 is active. Indicator lights may or may not be active depending on the set up. Box 307 illustrates switching from the passive mode to the active mode upon the second sensor 7 sensing that said piece of product 5 has been removed.

It could be conceivable that a piece of product has been dispensed in the active mode but not removed, and that the dispenser switches to the low scan mode after the second predetermined period of time. From the low scan mode, the dispenser returns to the active mode when the second sensor 7 is activated by a user removing the piece of paper.

In summary, and as explained above, embodiments of the invention can be implemented in various ways. For example, the dispenser can be configured so as to use a first, active mode together with a passive mode. Alternatively, the dispenser can be configured so as to use the active mode, the passive mode and also the low scan mode. Furthermore, the dispenser can be programmed (i.e. during manufacturing of the dispenser) to operate with any one of these configurations. Alternatively, the dispenser can be provided with an interface (not shown in the drawings) allowing an operator to choose any of these configurations.

Also, the dispenser can be configured with an interface allowing a user or operator of the dispenser to select the relevant time periods used for switching between the various operating modes. Different uses of a dispenser as described—for example in restrooms associated with for example offices, restaurants, cinemas, airports etc.—put different demands on the actual configuration of the dispenser. For this reason, it may be advantageous if a user or operator of the dispenser could be given access to the dispenser to set for example the actual—i.e. the first, second and third—time periods for switching between the different operating modes.

Embodiments of the invention can be realised both as a complete dispenser with all mechanics and electronics being built-in and as a dispenser insert including mechanics and electronics which can be removably mounted in an empty housing for a dispenser including a compartment for a sheet material product.

Reference signs mentioned in the claims should not be seen as limiting the extent of the matter protected by the claims, and their sole function is to make claims easier to understand.

As will be realised, the invention is capable of modification in various obvious respects, all without departing from the scope of the appended claims. Accordingly, the drawings and the description are to be regarded as illustrative in nature, and not restrictive.

The invention claimed is:

1. Hygienic sheet material dispenser comprising:
- a housing with a dispensing opening;
- a compartment for a sheet material product;
- a first sensor arranged to assume an active mode in which the first sensor actively scans for the presence of a user;
- a dispensing motor arranged to drive a driving mechanism;
- a second sensor for sensing when a piece of said product has been removed from the dispensing opening; and
- a microcontroller connected to the first sensor, the second sensor, and the dispensing motor,
- wherein said dispenser is configured to be switched to a passive mode,
- wherein the dispenser is configured to switch to the passive mode after a first predetermined period of time has elapsed with the first sensor in the active mode without detection of a user,
- wherein, upon the dispenser entering the passive mode, a length of said product is fed from the dispenser out of the dispensing opening and the first sensor and the microcontroller are substantially deactivated, and
- wherein the dispenser is configured to switch back to the active mode when the second sensor senses that said product has been removed from the dispensing opening.

2. The dispenser according to claim 1, wherein the first sensor is a capacitive proximity sensor.

3. The dispenser according to claim 1, wherein the first sensor is an infrared (IR) proximity sensor.

4. The dispenser according to claim 1, wherein said second sensor is a mechanical switch indicating that a user has removed a length of said product.

5. The dispenser according to claim 4, wherein said second sensor is activated by said product upon stretching said product during a tearing operation.

6. The dispenser according to claim 4, wherein said second sensor is activated by a tear bar arrangement.

7. The dispenser according to claim 1, wherein said second sensor is an optical sensor arranged for determining whether the product is removed or not.

8. The dispenser according to claim 1, wherein the first predetermined period of time is between 3 minutes and 60 minutes.

9. The dispenser according to claim 1, wherein the compartment for the product is arranged to hold a continuous roll of paper or a stack of folded continuous paper, and wherein the dispenser dispenses a predetermined length of paper upon activation of the first sensor or second sensor.

10. The dispenser according to claim 1, wherein the compartment for the product is arranged to hold a roll of paper sheets or a stack of connected paper sheets, and wherein the dispenser dispenses a sheet of paper upon activation of the first sensor or second sensor.

11. The dispenser according to claim 1, wherein the dispenser housing comprises a dispenser frame comprising a dispensing opening, and an insert being arranged to be removably inserted into the dispenser frame, wherein the first sensor, the dispensing motor arranged to drive the driving mechanism, the second sensor and the microcontroller are arranged in the insert.

12. Hygienic sheet material dispenser comprising:
- a housing with a dispensing opening;
- a compartment for a sheet material product;
- a first sensor arranged to assume an active mode in which the first sensor actively scans for the presence of a user with a first predetermined scan rate;
- a dispensing motor arranged to drive a driving mechanism;
- a second sensor for sensing when a piece of said product has been removed; and
- a microcontroller connected to the first sensor, the second sensor, and the dispensing motor,
- wherein said dispenser is configured to be switched to a passive mode,
- wherein the dispenser is arranged to switch to a low scan mode after a second predetermined period of time has elapsed with the first sensor in the active mode without detection of a user,
- wherein, in the low scan mode, the first sensor is arranged to scan for the presence of a user at a second predetermined scan rate which is lower than said first scan rate,
- wherein the dispenser is arranged to switch from the low scan mode to the passive mode after a third predetermined period of time has elapsed in the low scan mode without detection of a user,
- wherein, upon switching to the passive mode, said product is dispensed from the dispenser out from the dispensing opening and the first sensor and the microcontroller are substantially deactivated, and
- wherein the dispenser is arranged to switch back to the active mode upon the second sensor sensing that said product has been removed from the dispensing opening.

13. The dispenser according to claim 12, wherein the second predetermined period of time is between 0.5 and 20 minutes.

14. A method for controlling the operation of a hygienic sheet material dispenser, comprising a housing with a dispensing opening and a compartment for a sheet material product, said method comprising:
- scanning for the presence of a user by a first sensor during an active mode;
- driving a driving mechanism by a dispensing motor upon detecting the presence of a user by the first sensor;
- sensing whether a piece of said sheet material product has been removed by a second sensor;
- controlling the operation of the dispenser by a microcontroller connected to the first sensor, the second sensor and the dispensing motor,
- selectively switching said dispenser unit to a passive mode;
- switching from the active mode to the passive mode after a first predetermined period of time has elapsed in the active mode without detection of a user;

dispensing a piece of said product from the dispenser out from the dispensing opening upon switching to the passive mode and substantially deactivating the first sensor and the microcontroller; and switching back to said active mode when said second sensor senses that a piece of said product has been removed.

15. A method for controlling the operation of a hygienic sheet material dispenser, comprising a housing with a dispensing opening and a compartment for a sheet material product, said method comprising:

scanning for the presence of a user by a first sensor during an active mode and with a first predetermined scan rate;

driving a driving mechanism by a dispensing motor upon detecting the presence of a user by the first sensor;

sensing whether a piece of said sheet material product has been removed by a second sensor;

controlling the operation of the dispenser by a microcontroller connected to the first sensor, the second sensor and the dispensing motor;

selectively switching said dispenser to a passive mode;

switching from the active mode to a low scan mode after a second predetermined period of time has elapsed in the active mode without detection of a user;

scanning for the presence of a user, in said low scan mode, by said first sensor and with a second predetermined scan rate which is lower than said first scan rate;

switching from said low scan mode to said passive mode after a third predetermined period of time has elapsed in the low scan mode without detection of a user;

dispensing a piece of said product from the dispenser out from the dispensing opening upon switching to the passive mode and substantially deactivating the first sensor and the microcontroller; and switching from the passive mode and back to the active mode when the second sensor senses that said piece has been removed.

* * * * *